US005212897A

United States Patent [19]

Jefferson

[11] Patent Number: 5,212,897

[45] Date of Patent: May 25, 1993

[54] TRENCHING ATTACHMENT FOR AN EARTH MOVING BUCKET

[76] Inventor: Stuart T. Jefferson, 9207 Ox Rd., Lorton, Va. 22079

[21] Appl. No.: 867,339

[22] Filed: Apr. 13, 1992

[51] Int. Cl.[5] ..... E02F 5/02

[52] U.S. Cl. ..... 37/103; 37/141 R; 37/DIG. 12

[58] Field of Search ..... 37/117.5, 118 R, 141 R, 37/DIG. 3, DIG. 12, 103, 80 A

[56] References Cited

U.S. PATENT DOCUMENTS

| | | | |
|---|---|---|---|
| 3,089,261 | 5/1963 | Flath | 37/118 R |
| 3,469,330 | 9/1969 | Hood et al. . | |
| 4,043,061 | 8/1977 | Heitman . | |
| 4,360,980 | 11/1982 | Jarvis . | |
| 4,476,641 | 10/1984 | Ballinger | 37/118 R |
| 4,704,811 | 11/1987 | Jefferson . | |
| 4,719,711 | 1/1988 | Sieber et al. | 37/118 R |
| 4,896,444 | 1/1990 | Sieber et al. | 37/118 R |

*Primary Examiner*—Dennis L. Taylor
*Assistant Examiner*—J. Russell McBee
*Attorney, Agent, or Firm*—Richard C. Litman

[57] ABSTRACT

A trenching attachment for use on a toothed earth moving bucket which converts conventional backhoe or similar earth moving machines into devices capable of excavating a continuous trench. The attachment may be mounted on any toothed earth moving bucket, and includes an anchoring and connecting arrangement which transfers a substantial portion of the frictional drag load generated during trench excavation operations from the attachment to the base of a backhoe's articulated boom. Furthermore, during trenching operations, the operator may control the depth of the V-shaped excavation with the backhoe or similar earth moving machine's hydraulic controls as such is driven forward, creating graded trenches for the installation of subsurface conduits, cables and the like.

20 Claims, 5 Drawing Sheets

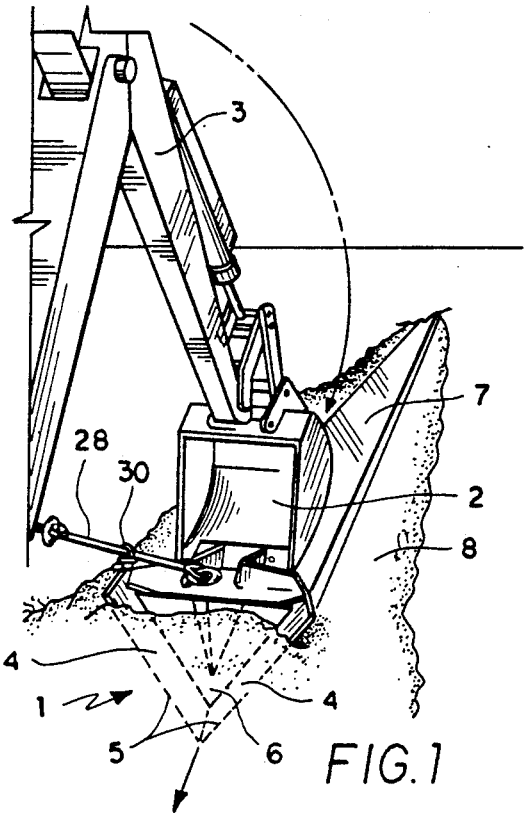
FIG. 1
FIG. 3
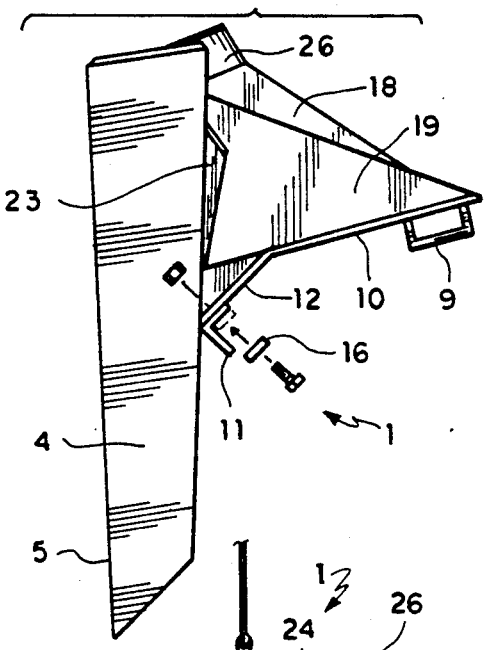
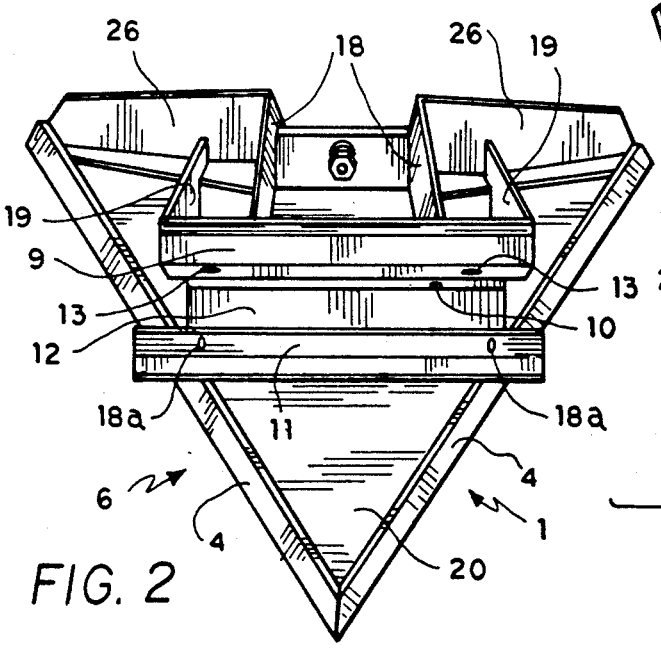
FIG. 2
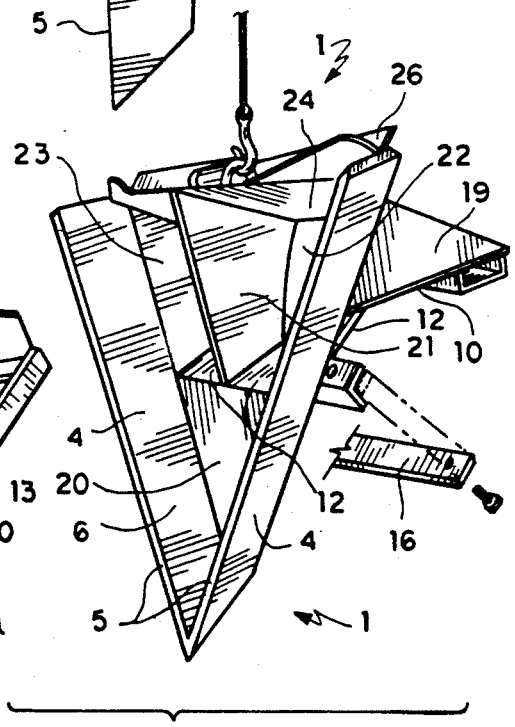
FIG. 4

FIG. 10
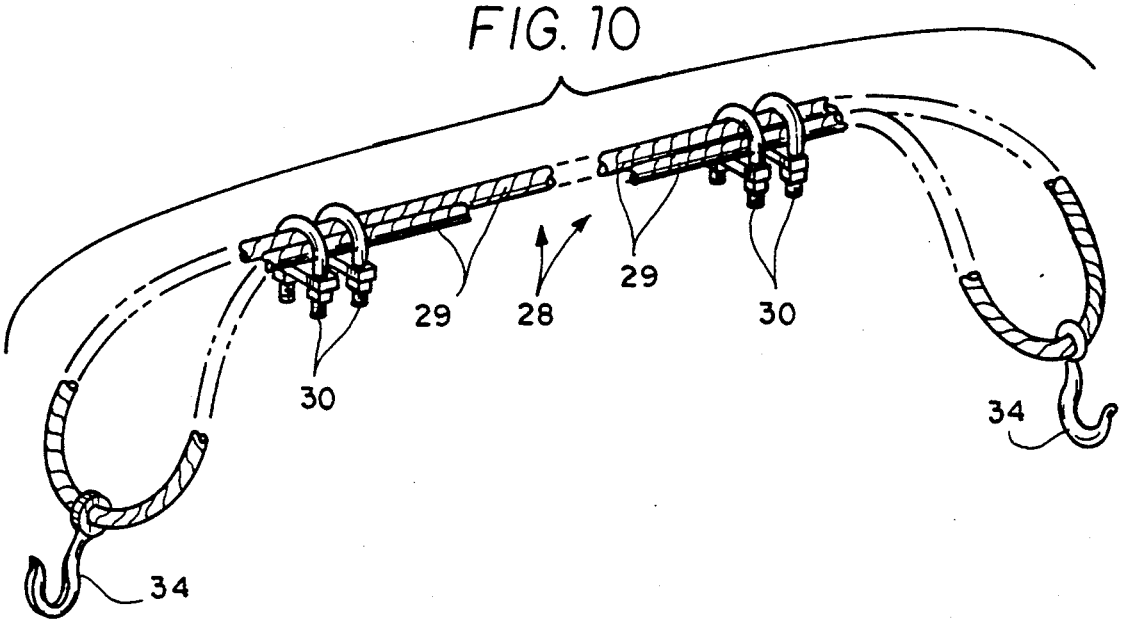
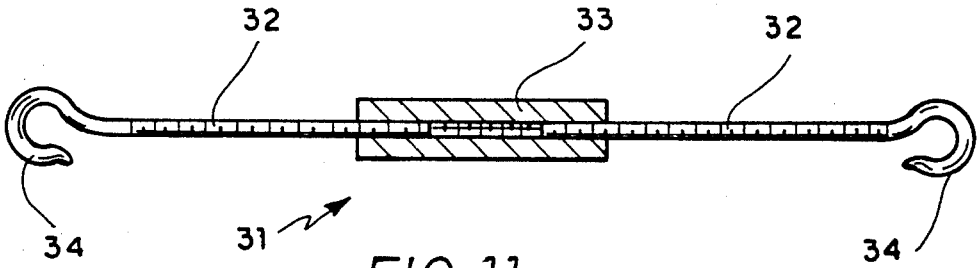
FIG. 11

TRENCHING ATTACHMENT FOR AN EARTH MOVING BUCKET

FIELD OF THE INVENTION

This invention relates to machinery for digging furrows or trenches in the earth. Particularly, it involves an attachment to an earth moving bucket which converts the bucktet's function as a scoop to that of a plow.

BACKGROUND OF THE INVENTION

Earth moving machines are often seen at today's construction sites. These large pieces of equipment are generally classified as "backhoes" or "front end loaders" depending on the configuration of the machine's hydraulic boom and the earth moving bucket attached thereto. Backhoes and front end loaders are often employed at a site for specific purposes. The well-known backhoe with its relatively small bucket is primarily a ditch digging machine. On the other hand, the front end loader is usually employed in lifting or pushing large volumes of soil with its wide bucket. With the present inventive bucket attachment, a machine equiped with a bucket of either configuration can be converted into one capable of producing a continuous trench.

During conventional operation, the backhoe's hydraulic boom, equipped with an earth moving bucket at its distal end, is extended and retracted in such a manner as to excavate a depression in the ground's surface. Mechanical limitations of the boom restrict the length of the depression which may be excavated.

Human frailty coupled with the mechanical complexity of the machine provide substantial limitations upon a backhoe's use. Because the typical backhoe possesses complex controlling means, a backhoe operator must focus upon either digging operations or locomotion of said machine over the ground's surface at any given point in time. For this reason, the backhoe is usually placed in a given position relative to the ground while its boom is employed in digging activities. To extend an excavation beyond the sweep of the backhoe boom's reach, digging operations must cease and the machine must be moved. Consequently, the excavations of a backhoe are generally of limited lateral extent.

The front end loader, on the other hand, is best suited to moving large volumes of relatively unconsolidated materials. Such a machine is not particularly well suited to digging within the earth because of the large size of its bucket. For this reason, it is usually employed in pushing earthen material along the ground's surface or lifting such to a desired location. Excavating shallow trenches with its earth moving bucket alone is not possible.

With the installation of the present inventive attachment upon an earth moving bucket, the bucket is converted into a V-shaped trenching tool. As such, the bucket may excavate a trench while being moved continuously forward. Furthermore, the depth of the trench may be varied along its distance, and when employed in a different attitude relative to the ground, the attachment of this invention provides a means for backfilling the previously excavated trench and returning the earth's surface to its original grade.

The trenches or furrows excavated by the trenching attachment may be employed in a variety of useful endeavors. Among others, said furrows or trenches have been found eminently suitable for the installation of underground pipes and the like. Beyond this, the invention may be used to create fire breaks in wooded or grassy areas thus preventing the spread of ground fires which, if unchecked, cause substantial damage to natural and man-made resources.

I have thus outlined rather broadly the important features of my invention in order that the detailed description thereof that follows may be better understood, and in order that my contribution to the art may be appreciated. There are, of course, additional features of my invention that will be described hereinafter. Such features will form the subject of claims appended hereto. As those skilled in the art will appreciate, my disclosure may be readily utilized as a basis for the designing of other similar mechanisms for carrying out the purposes of my invention. Therefore, it is important that the aforesaid claims be regarded as including such equivalent constructions as do not depart from the spirit and scope of my invention.

DESCRIPTION OF THE PRIOR ART

Various types and styles of earth moving bucket attachments have been developed over time. While it is believed that most of these attachments have proved satisfactory for their intended purposes, the present invention has been developed to provide an attachment suitable for continuous furrow or trench excavation activities only. In addition, the attachment may be installed and utilized upon buckets of varying sizes. Such a device has not been revealed in the prior art. In order to illustrate the novelty of the present invention, it is necessary to review previous developments in this field.

Four patents have been uncovered which are believed to be of particular relevance in this matter: U.S. Pat. Nos.: 3,469,330, issued Sep. 30, 1969 to John W. Hood et al; 4,043,061, issued Aug. 23, 1977 to LeRoy Marvin Heitman; 4,360,980, issued Nov. 30, 1982 to Jack D. Jarvis; and 4,704,811, issued Nov. 10, 1987 to the present applicant. Each of these devices may be distinguished from the trenching attachment which is the subject of this application.

U.S. Pat. No. 3,469,330, issued to Hood et al, describes a rectangular, earth-moving blade attachment with pockets attached to its convex surface designed to widen the "cut" of a conventional backhoe bucket. To mount the blade upon a backhoe bucket, the bucket's teeth are lowered into corresponding openings in the pockets, and bolts are employed to lock the blade into position. Continuous trench excavation operations cannot be performed by Hood's device as its blade's large, planar surface precludes the efficient cutting and lifting of soil in a continuous fashion. Additionally, the pockets of the Hood device require backhoe bucket teeth of corresponding spacing in order for the blade attachment to be mounted. The present inventive trenching attachment, however, is universally mountable upon any earth moving bucket regardless of the bucket's teeth spacing.

U.S. Pat. No. 4,043,061, issued to Heitman, discloses a ground shaping system attachable to, and usable with, a backhoe bucket for shaping the upper portions of a ditch being excavated by the bucket. When the system is employed, C-shaped clamps attach two or more cutting members to the side wall of a backhoe bucket. The present inventive trenching attachment, on the other hand, is affixed to the inside bottom of an earth moving bucket and not to the bucket's sides.

U.S. Pat. No. 4,360,980, issued to Jarvis, illustrates a blade member attachment and a manner of securing a blade member to a backhoe bucket. An inclined plate, joined to the blade member, forms a wedge into which the teeth of a backhoe bucket are inserted. The blade member is not suitable for continuous trenching operations due to its broad, flat shape. Also, ratchet and turnbuckle combination assure the firm retention of said blade member to the backhoe for work upon the soil. In contrast, the present inventive attachment requires no mechanical ratchets or turnbuckles subject to wear, corrosion, or jamming to secure the attachment to an earth moving bucket.

U.S. Pat. No. 4,704,811, issued to this inventor, describes V-shaped trenching attachment for a backhoe. My prior V-shaped trenching attachment is improved upon by the present inventive device as follows. First, the present attachment moves soil along its surface, depositing it as a berm beside the excavated trench, rather than funneling soil into the bucket as was previously done. Second, the present invention incorporates a mounting allowing ready attachment to a variety of earth moving bucket types and models. Third, the present attachment incorporates an anchor for maintaining the position of the trenching attachment relative to a backhoe. Specifically, a cable, or similar load transferring member, connects an eyehook located upon the bucket attachment with the first segment of the backhoe's boom. Finally, cutting blade extension members may be added to the attachment which assist in excavating deeper trenches, or in the more rapid backfilling of excavations, depending upon the positioning of the extension members. The foregoing advantages offered by the present trenching attachment are believed to be substantial improvements over the existing art.

SUMMARY OF THE INVENTION

The invention is a V-shaped trenching tool for attachment to the conventional earth moving bucket which converts the bucket into a continuous trenching device. The tool is readily installed and removed from the bucket and permits the bucket to be used to dig trenches for the installation of subsurface pipes, telephone, television transmission or power cables, or to create fire breaks. The conventional hydraulic system of the earth moving machine may be used to move the tool vertically within the ground as it is being driven forward to create graded trenches such as those required when installing drainage piping or the like.

A load transfer device (hereinafter LTD) made up of wire rope, cable, chain, rod or similar materials, may be employed to connect the trenching attachment to a point at or near the base of the boom of a backhoe unit. The LTD is constructed in such a way as to be both detachable from the backhoe as well as adjustable. Adjustments of the LTD's length have been found necessary to conform to variations in backhoe boom dimensions from machine to machine as well as variations in the angle at which the inventive blade is set relative to the ground surface.

Setting the length of the LTD is usually accomplished by mounting the trenching device upon a given backhoe bucket as will as be described below. Next, the hydraulic arm of the backhoe is adjusted so as to place the blade at its desired cutting angle, normally perpendicular to the ground. Finally, the LTD is placed upon the machine and lengthened or shortened as necessary to acquire a taut fit. This final adjustment is locked into place by means of clamps or thereaded sleeves.

When employing an earth moving bucket as a continuous trencher, the blade of the tool is inserted into the ground and the depth of cut is set using the backhoe or front end loader boom's hydraulic system. The bucket is then moved forward, creating a V-shaped ditch of a width and depth as was previously set. While in movement, the depth of the trench may be adjusted, again using the hydraulic controls of the earth moving machine, to create graded trenches.

Markings may be provided on the attachment's cutting blades to enable the operator to gauge the depth of cut, thus assisting him in creating an evenly graded trench.

When the trench is to be refilled, the earth moving bucket is returned to its original starting position and rotated until the trenching attachment's blade is parallel to and in contact with the ground. The bucket is next moved forward and the backfill blade sweeps the berm of previously cut earth adjacent to the walls of the excavation back into the hollow. In this manner an evenly graded surface is provided upon completion of the digging operation.

Accordingly, it is a principal object of the invention to provide an improved trenching attachment for an earth moving bucket which is disposed in a first attitude for trenching and a second attitude for refilling the trench.

It is another object of the invention to provide an improved trenching attachment for an earth moving bucket having a triangular plow face with cutting plates, the plow face being configured to form two adjacent earth transfer channels, thus to form two neat berms of spoil material to either said of a trench formed by the attachment.

It is a further object of the invention to provide an improved trenching attachment which is readily attached by being clamped to the teeth of a conventional earth moving bucket.

Yet another object of the invention is to provide an improved trenching attachment for an earth moving bucket having a load transfer securement connecting the attachment with a backhoe boom to reduce load on the boom's hydraulic cylinders and to assist in stabilizing the trenching attachment.

It is still a further object of the invention to provide an improved bucket attachment for both trenching and refilling which is of sturdy construction and made of a minimum of individual parts so as to be low in cost of manufacture.

BRIEF DESCRIPTION OF THE DRAWINGS

FIG. 1 is a perspective view of a backhoe having the trenching attachment mounted thereon and a trench resulting from excavation operations.

FIG. 2 is a bottom view of the trenching attachment.

FIG. 3 is a partially exploded, side elevational view of the trenching attachment.

FIG. 4 is a partially exploded, elevational perspective view of the trenching attachment.

FIG. 10 is a fragmentary perspective view of one embodiment of a load transfer device (LTD) for interconnecting the trenching attachment with the backhoe's articulated boom.

FIG. 11 is a sectional view of another embodiment of an LTD.

DESCRIPTION OF THE PREFERRED EMBODIMENTS

Figure 5:
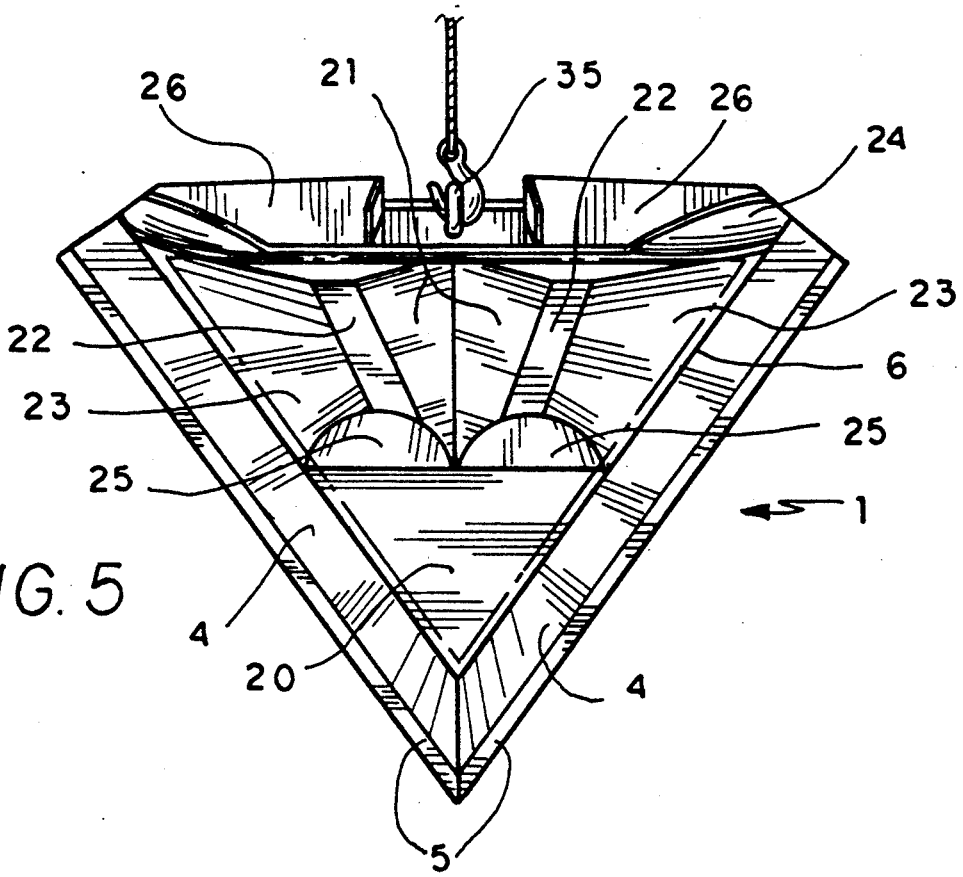
FIG. 5 is a top plan view of the trenching attachment.

Referring now to the drawings and in particular to FIGS. 1 and 5, the trenching attachment 1 is positioned upon a backhoe bucket 2 which is pivotally joined to the distal end of a backhoe's articulated boom 3. Trenching attachment 1 has twin, integral cutting plates 4,4 provided with sharp cutting edges 5. A plow face 6 of triangular outline is fitted and joined between said cutting plates 4. When cutting plates 4 are vertically disposed below the ground's surface and the backhoe is driven forward, the plow face 6 lifts the excavated earthen spoil material from the furrow or trench 7 depositing said spoil material as a berm 8 on each side of trench 7.

FIGS. 2 and 3 illustrate a mounting for trenching attachment 1 to the inside bottom of said backhoe bucket 2. A bottom mounting bar 9 of C-shaped configuration in cross section, and joined to a bottom mounting plate 10, and a bottom mounting bracket 11, joined to a transitional mounting member 12, are placed in contact with backhoe bucket 2. Opposing holes 13 piercing bottom mounting bar 9 and the backhoe bucket 2 allow for the insertion of fasteners, rivets, or the like 14, connecting trenching attachment 1 to bucket 2. Additional support for the trenching attachment 1 is provided with the backhoe bucket teeth 15 being placed within bracket 11, which is L-shaped in cross section, and a bracket clamp bar 16, attached to bracket 11, to sandwich bucket teeth 15 therebetween. A positive connection is accomplished with threaded fasteners, rivets, welds, or the like 17, fitted through holes 18*a*,18*a*, located in bracket 11 and bar 16. In this manner, clamp bar 16 and bracket 11 clamp bucket teeth 15 in a vise like grip.

Figure 6:
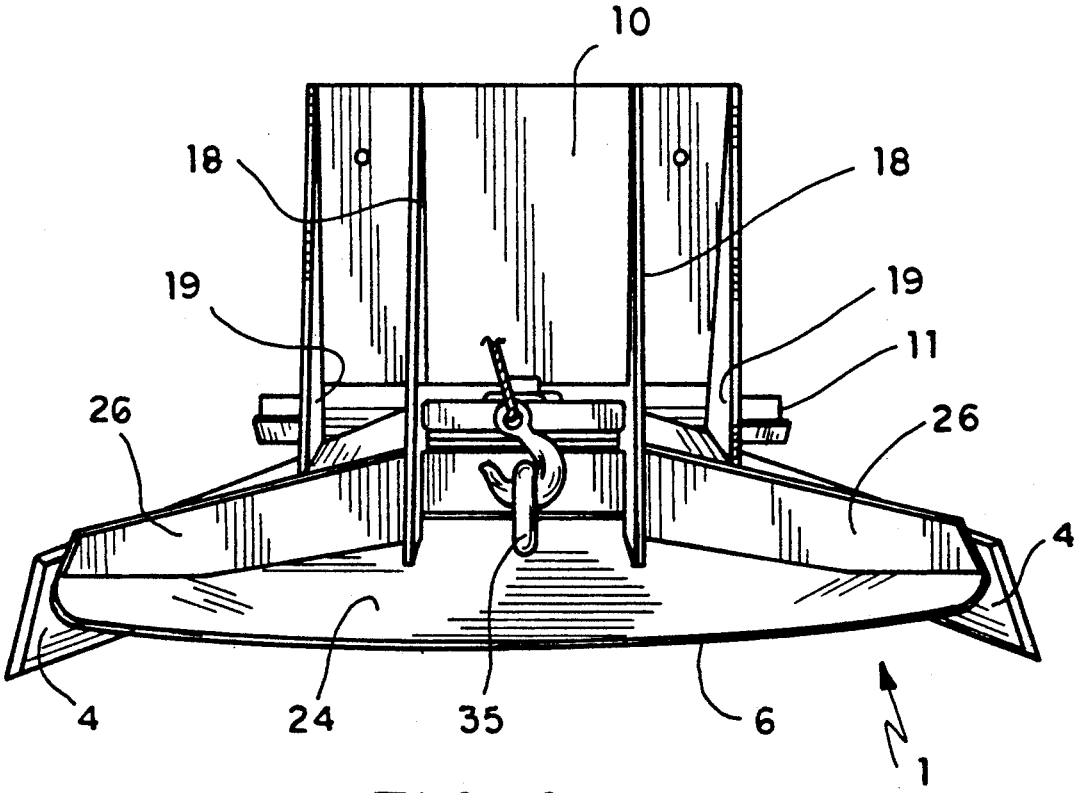
FIG. 6 is a rear elevational view of the trenching attachment as shown in FIGS. 1-5 and drawn to an enlarged scale.

Referring now to FIG. 6, reinforcement for the plow face 6 is provided by two interior reinforcement plates 18 substantially perpendicularly joined to bottom mounting plate 10 and plow face 6, in addition to two, side reinforcement plates 19 substantially parallel to and laterally spaced from said interior reinforcement plates 18 joining said bottom mounting plate 10 and said plow face 6.

Turning now to FIGS. 4 and 5, said triangular plow face 6 is illustrated in detail. Ten planar elements including a primary plowing plate 20, two interior plowing plates 21, two medial plowing plates 22, two exterior plowing plates 23, a spoil spreader plate 24, and two semicircular areas 25, all integrally joined comprise the plow face 6. Semicircular areas 25 are formed by the joining of said plowing plates 20, 21, 22, and 23 to the top face of said transitional mounting member 12. Plow face 6 may be constructed from any suitably strong material such as metal alloy, plastic or graphite composite.

Spoil material generated during trenching operations generally travels from cutting blades 4,4 to the plow face 6. Once spoil material comes in contact with the plow face 6, it is forced upward and outward from the plow face's vertical centerline, which is partially defined by the junction of plowing plates 21, 21, as seen in FIG. 5. The two lateral channels formed on each side of the plow face's centerline, each channel being defined by plowing plates 21, 22, and 23, facilitate this motion. To prevent material from cascading over trenching attachment 1 and into backhoe bucket 2, thus impeding trenching operations, spoil spreader plate 24 deflects material from the lateral channels just described onto the ground's surface outside the cut of the trenching attachment 1. In this manner, spoil berms 8 are formed adjacent to the excavated furrow or trench 7.

Figure 7:
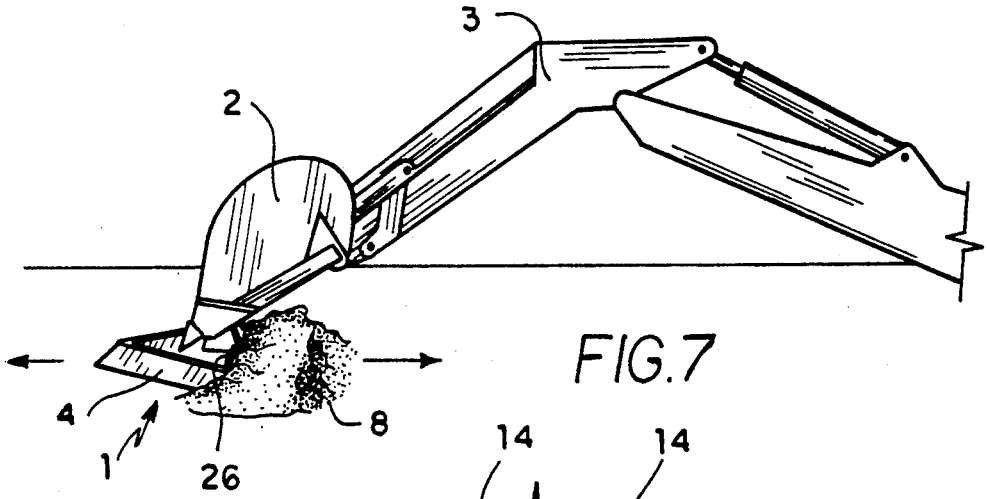
FIG. 7 is a side elevational view of the mounted trenching attachment, positioned for trenching operations by a backhoe arm.
Figure 8:
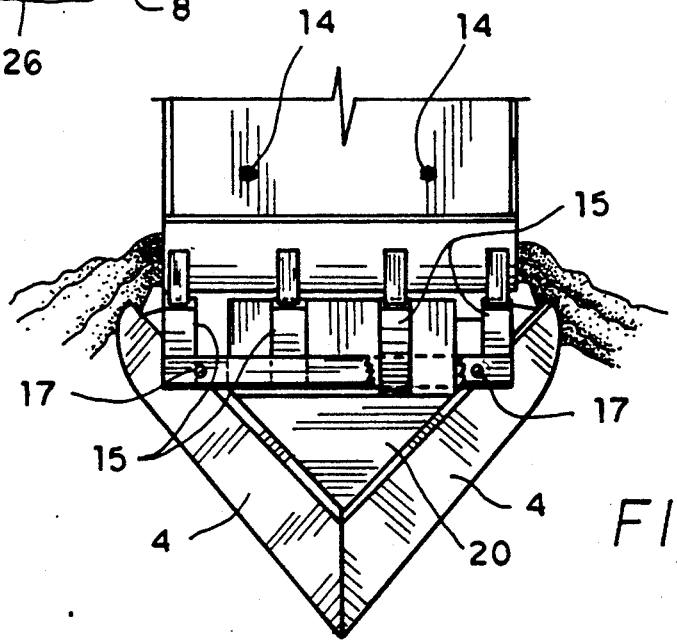
FIG. 8 is a front view of the mounted trenching attachment positioned for backfilling operations.

Referring now to FIGS. 6 and 7, a backfill plate 26 joined to plow face 6 is shown. When trench 7 is to be refilled, the backhoe is returned to its original starting position, and backhoe bucket 2 is rotated until cutting plates 4,4 are parallel to and in contact with the ground. The backhoe is next driven forward (or to the right in the sense of FIG. 7) and backfill plate 26 sweeps the berm of previously excavated spoil 8 adjacent to the sides of the trench back into the excavation. In this manner, an evenly graded surface is provided upon completion of the trenching operation.

Figure 9:
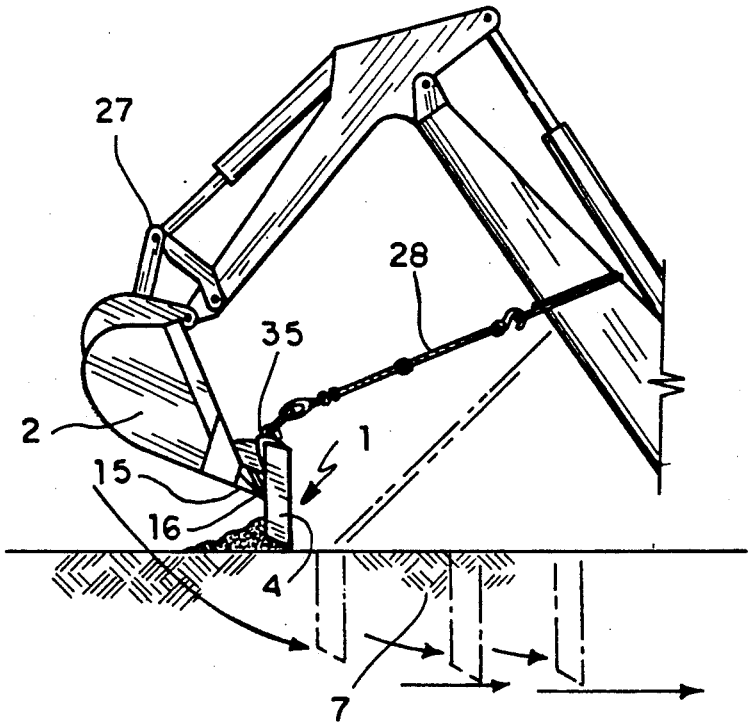
FIG. 9 is a side elevational view of the trenching attachment mounted upon a backhoe bucket positioned for backfilling operations.

Referring now to FIG. 9, trenching attachment 1 is connected to bucket 2 of a backhoe in the position that it would usually appear when being employed in excavating a trench. Trenching attachment 1 is positioned so that cutting plates 4,4 are perpendicular to the ground's surface. The position of bucket 2 is controlled by conventional backhoe linkage 27 which will not be further described, but which permits the backhoe bucket 2 to be pivoted about a horizontal axis and lifted into various positions. From this position, cutting plates 4,4 are lowered into the earth by articulated boom 3. When the backhoe is driven forward, a V-shaped furrow or trench 7 is excavated.

The LTD 28 provides support for the trenching attachment 1 by connecting attachment 1 to the base of backhoe articulated boom 3 and additionally transfers the frictional drag loads generated while attachment 1 is in employed in trenching operations.

FIGS. 10 and 11 show two embodiments of an LTD. FIG. 10 discloses an LTD 28 made up of metallic cable material or wire rope 29. Cable material 29 is looped at both ends and is adjustable in length. LTD 28 may be lengthened or shortened by unfastening c-clamps 30 and, respectively, adding or subtracting slack cable to or from the loops and refastening clamps 30. In FIG. 11, an LTD 31 includes two segmented and threaded metallic rods 32, fastened to one another by a threaded sleeve 33 which allows the length of the LTD 31 to be adjusted.

Hooks 34, provided at the ends of LTD 28 and LTD 31, allow for the mounting of either LTD 28 or LTD 31 to eyehook 35 joined to trenching attachment 1 and the base of boom 3 as shown in FIG. 9.

Although only two separate embodiments of the LTD are disclosed, it is readily appreciated that LTDs may be constructed with configurations different from those described above. First, either of the described devices 28 and 31 may be easily constructed from metal alloys. It is foreseen, however, that materials such as plastics, natural and man-made fibers, and graphite composites, among others, may also be employed for the purposes disclosed. Additionally, it is believed that an LTD made of linked chain, ribbon, belt, or the like would function equally well. Therefore, the specific embodiments disclosed in FIGS. 10 and 11 should be regarded as including such equivalent constructions as do not depart from the spirit and scope of my invention.

During the trenching operation, the operator of the backhoe may raise or lower bucket 2 and trenching attachment 1 attached thereto with the backhoe controls to provide a trench having a variable grade such as those required for the installation of sloped drainage pipes, underground cables and sewer lines.

Figure 12:
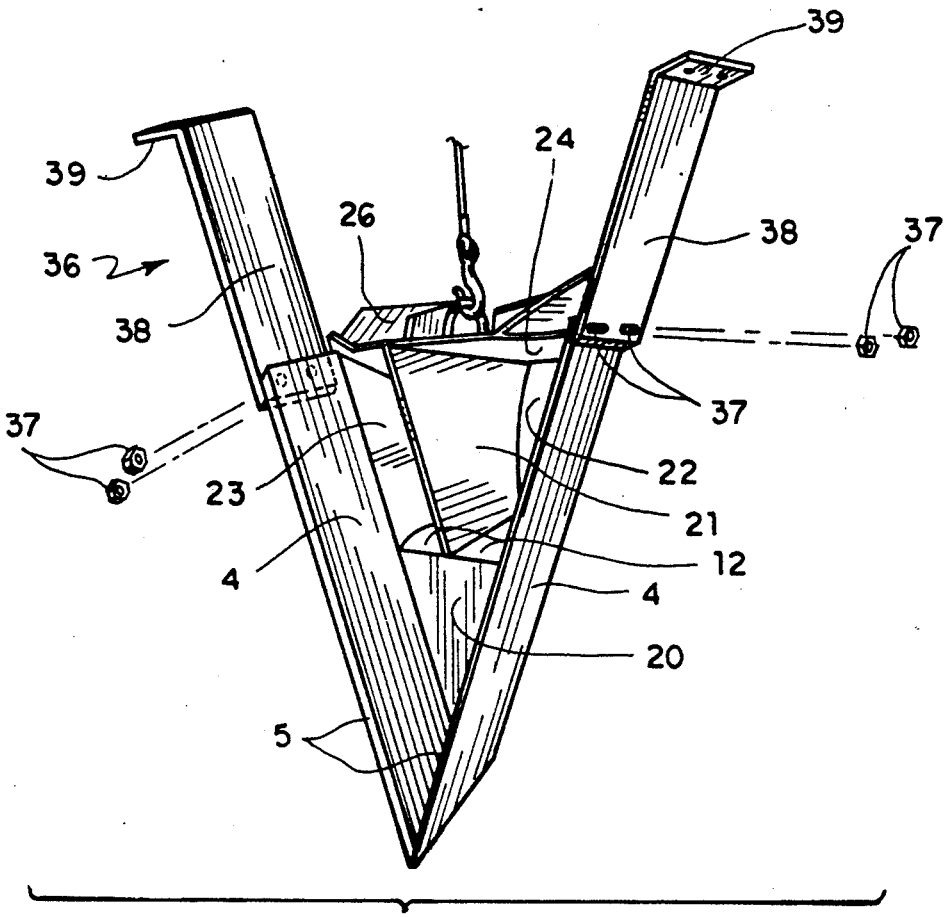
FIG. 12 is a partially exploded, elevational perspective view of the trenching attachment with cutting blade extension members fixed thereto in a manner suitable for trench digging operations.
Figure 13:
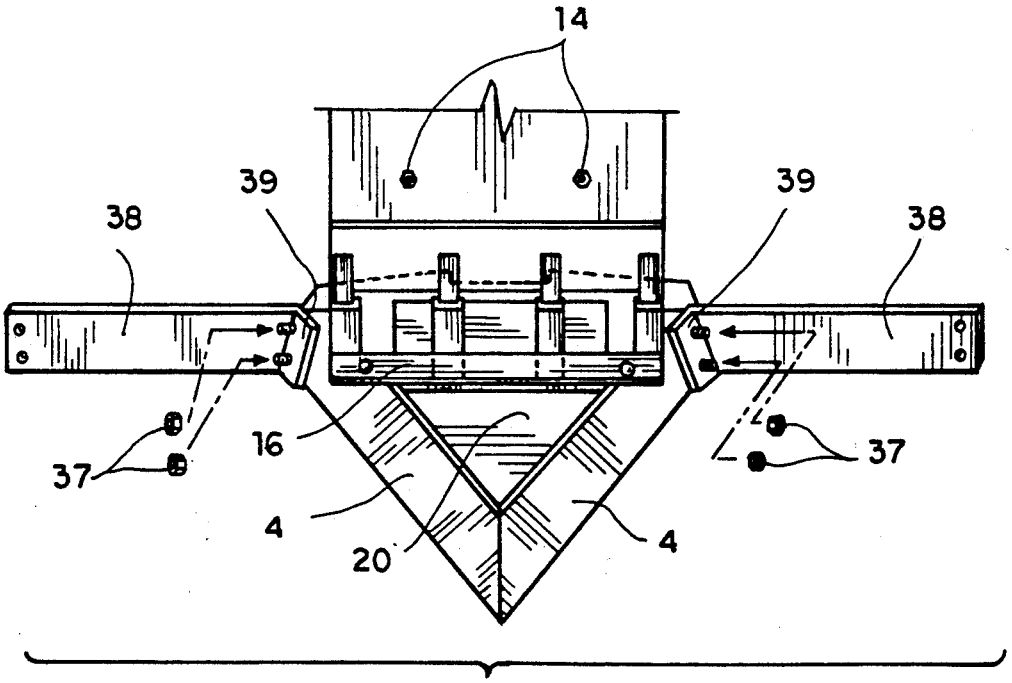
FIG. 13 is a front view of the trenching attachment shown in FIG. 12, mounted upon a backhoe bucket with cutting blade extension members fixed thereto in a manner suitable for trench backfilling operations.

It is possible to modify the trenching attachment 1 by the addition of cutting blade extension members 36 as shown in FIGS. 12 and 13. Extension members 36 may be removably mounted to said cutting plates 4,4 by nut and bolt assemblies, for example, fitted through opposing holes provided within said extension members 36 and said cutting plates 4,4. When trenching attachment 1 is being employed in trench excavation operations with cutting plates 4,4 vertically disposed to the ground's surface, and the long legs 38 of extension members 36 are attached to cutting plates 4,4, trenching attachment 1 may be utilized to excavate a trench of greater depth than it could produce without extension members 36. Additionally, when trenching attachment 1 is being employed in trench backfilling operations with cutting plates 4,4 horizontally disposed to, and in contact with, the ground's surface, the short legs 39 of extension members 36 may be attached to cutting plates 4,4. When the backhoe is thus driven forward, a greater volume of spoil may be swept into the excavated trench at a given time than could be accomplished without extension members 36. As a result, greater operating efficiencies in backfilling are realized.

It is to be understood that the present invention is not limited to the embodiments described above, but encompasses any and all embodiments within the scope of the following claims.

What is claimed is:

1. A trenching attachment for a toothed earth moving bucket, the bucket being pivotally joined to the distal end of an earth moving machine's articulated boom, the attachment comprising: two cutting plates, angularly joined to form a V shape and having cutting edges for slicing the ground's surface; a plow face of triangular outline fitted and joined between said cutting plates; and means for mounting said trenching attachment to the inside bottom of an earth moving bucket; whereby said cutting plates, plow face, and mounting means form a single trenching attachment to the earth moving bucket which, when said cutting plates are vertically disposed below the ground's surface and the earth moving machine is driven forward, plows a V-shaped trench, thus lifting excavated earthen spoil material and depositing a spoil berm on each side of the trench.

2. The trenching attachment of claim 1, wherein said means for mounting said trenching attachment to the inside bottom of an earth moving bucket comprises a bottom mounting bar of C shaped cross section, fastener means for mounting said bottom mounting bar onto the earth moving bucket, a bottom mounting plate angularly joined to said plow face and affixed to said bottom mounting bar, a transitional mounting plate angularly joined to said bottom mounting plate, a bottom mounting bracket fixed to said transitional mounting plate, said bracket having an L shaped cross section, a bracket clamp bar spanning the length of the bottom mounting bracket, and means for adjustably mounting said bracket clamp bar to said bracket, said bottom mounting bar and said bracket clamp bar being arranged and dimensioned to clamp said bucket teeth therebetween in vise-like grip fashion.

3. The trenching attachment of claim 1, wherein said plow face includes a bottom mounting plate angularly joined to said plow face, two interior reinforcement plates substantially perpendicularly joined to said bottom mounting plate and said plow face and two side reinforcement plates, substantially parallel to and laterally spaced from said interior reinforcement plates, joining said bottom mounting plate and said plow face; whereby said interior reinforcement plates and said side reinforcement plates provide a rigid structure facilitating trenching operations by strengthening said plow face.

4. The trenching attachment of claim 1, further comprising means for anchoring said trenching attachment to the conventional boom of a backhoe including an anchor plate joined to said plow face, an eyebolt attached to said anchor plate, and detachable load transferring means having two ends, one end of said load transferring means connected to said eyebolt and the other end thereof connected to a point adjacent the base of the backhoe boom, whereby a substantial portion of the frictional drag load generated by the plow face moving through the earth during trenching operations is transmitted through said load transferring means directly to the base of the backhoe boom, thereby reducing the load upon the boom hydraulic cylinders and stabilizing said trenching attachment.

5. The trenching attachment of claim 4, wherein said load transferring means further comprise a wire cable looped at both ends, and clamping means for forming said ends of said wire cable, the length of said wire cable between its ends being adjustable in length by selective adjustment and clamp positioning of said clamping means.

6. The trenching attachment of claim 4, wherein said load transferring means comprise a plurality of segmented and threaded rods, and threaded sleeve means adjoining adjacent rods.

7. The trenching attachment of claim 1, wherein said plow face includes means defining a plurality of planar surfaces, whereby said surfaces collect, lift, and direct excavated earthen spoil material from a trench, and deposit spoil material as berms to each side of the trench.

8. The trenching attachment of claim 1, further including a backfill plate joined to said plow face, whereby when said plow face is horizontally disposed with respect to the ground's surface, thereby permitting contact of said backfill plate with the ground's surface, said backfill plate collects berm material generated during prior trench excavating operations, and replaces it in the trench as the earth moving machine is driven forward.

9. The trenching attachment of claim 1, further comprising a pair of cutting plate extension members removably mounted to said cutting plates distally from the junction of said cutting plates, said members being substantially L-shaped, and each having a long leg and a short leg, whereby when said long legs of said extension members are fastened to the cutting plates and said cutting plates are vertically disposed below the ground's surface, the earth moving machine being driven forward, a V-shaped trench is plowed depositing a spoil berm on each of the trench's sides, and when said short legs of said extension members are fastened to the cutting plates, and said cutting plates are horizontally disposed with respect to the ground's surface, the earth moving machine being driven forward, said extension members collect berm material generated during trench excavating operations and replace it in the trench.

10. A trenching attachment for use on a toothed backhoe bucket pivotally joined to the distal end of a backhoe's articulated boom comprising: two cutting plates, angularly joined so as to form a V shape and having cutting edges for slicing the ground's surface; a plow face of triangular outline fitted and joined between said cutting plates; means for mounting said trenching attachment to the inside bottom of the earth moving bucket; and a means for anchoring and connecting said trenching attachment to a backhoe boom; whereby said cutting plates, plow face, mounting means, and said anchoring and connecting means form a single trenching attachment to said backhoe bucket which, when said cutting plates are vertically disposed below the ground's surface and the backhoe is driven forward, plows a V-shaped trench, lifting excavated earthen spoil material and depositing a spoil berm on each side of the trench.

11. The trenching attachment of claim 10, wherein said means for mounting said trenching attachment to the inside bottom of a backhoe bucket comprises a bottom mounting bar of C shaped cross section, fastener means for mounting said bottom mounting bar onto the backhoe bucket, a bottom mounting plate angularly joined to said plow face and affixed to said bottom mounting bar, a transitional mounting plate angularly joined to said bottom mounting plate, a bottom mounting bracket fixed to said transitional mounting plate, said bracket having an L shaped cross section, a bracket clamp bar spanning the length of the bottom mounting bracket, and means for adjustably mounting said bracket clamp bar to said bracket, said bottom mounting bar and said bracket clamp bar being arranged and dimensioned to clamp said backhoe teeth therebetween in vise-like grip fashion.

12. The trenching attachment of claim 10, wherein said plow face includes a bottom mounting plate angularly joined to said plow face, two interior reinforcement plates substantially perpendicularly joined to said bottom mounting plate and said plow face, and two side reinforcement plates, substantially parallel to and laterally spaced from said interior reinforcement plates, joining said bottom mounting plate and said plow face; whereby said interior reinforcement plates and said side reinforcement plates provide a rigid structure facilitating trenching operations by strengthening said plow face.

13. The trenching attachment of claim 10, wherein said means for anchoring and connecting said trenching attachment to a backhoe boom comprise an anchor plate joined to said plow face, an eyebolt attached to said anchor plate, and detachable load transferring means having two ends, one end of said load transferring means connected to said eyebolt and the other end thereof connected to a point adjacent the base of the backhoe boom, whereby a substantial portion of the frictional drag load generated by the plow face moving through the earth during trenching operations is transmitted through said load transferring means directly to the base of the backhoe boom, thereby reducing the load upon the boom hydraulic cylinders and stabilizing said trenching attachment.

14. The trenching attachment of claim 13, wherein said load transferring means further comprise a wire cable looped at both ends, and clamping means for forming said ends of said wire cable, the length of said wire cable between its ends being adjustable in length by selective adjustment and clamp positioning of said clamping means.

15. The trenching attachment of claim 13, wherein said load transferring means comprise a plurality of segmented and threaded rods, and threaded sleeve means adjoining adjacent rods.

16. The trenching attachment of claim 10, wherein said plow face includes means defining a plurality of planar surfaces, whereby said surfaces collect, lift, and direct excavated earthen spoil material from a trench, and deposit spoil material as berms to each side of the trench.

17. The trenching attachment of claim 10, further including a backfill plate joined to said plow face, whereby when said plow face is horizontally disposed with respect to the ground's surface, thereby permitting contact of said backfill plate with the ground's surface, said backfill plate collects berm material generated during prior trench excavating operations, and replaces it in the trench as the backhoe is driven forward.

18. The trenching attachment of claim 11, further comprising a pair of cutting plate extension members removably mounted to said cutting plates distally from the junction of said cutting plates, said members being substantially L-shaped, and each having a long leg and a short leg, whereby when said long legs of said extension members are fastened to the cutting plates and said cutting plates are vertically disposed below the ground's surface, the backhoe being driven forward, a V-shaped trench is plowed depositing a spoil berm of each of the trench's sides, and when said short legs of said extension members are fastened to the cutting plates, and said cutting plates are horizontally disposed with respect to the ground's surface, the backhoe being driven forward, said extension members collect berm material generated during trench excavating operations and replace it in the trench.

19. The invention as claimed in claim 1, further comprising, in combination, an otherwise conventional backhoe.

20. The invention as claimed in claim 10, further comprising, in combination, an otherwise conventional backhoe.

* * * * *